US011614234B2

(12) United States Patent
Bunel et al.

(10) Patent No.: US 11,614,234 B2
(45) Date of Patent: Mar. 28, 2023

(54) TURBINE ENGINE COMBUSTION CHAMBER

(71) Applicant: SAFRAN AIRCRAFT ENGINES, Paris (FR)

(72) Inventors: Jacques Marcel Arthur Bunel, Moissy-Cramayel (FR); Dan-Ranjiv Joory, Moissy-Cramayel (FR); Patrice André Commaret, Moissy-Cramayel (FR); Romain Nicolas Lunel, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 811 days.

(21) Appl. No.: 16/476,776

(22) PCT Filed: Jan. 4, 2018

(86) PCT No.: PCT/FR2018/050021
§ 371 (c)(1),
(2) Date: Jul. 9, 2019

(87) PCT Pub. No.: WO2018/130765
PCT Pub. Date: Jul. 19, 2018

(65) Prior Publication Data

US 2019/0360698 A1 Nov. 28, 2019

(30) Foreign Application Priority Data

Jan. 10, 2017 (FR) ..... 1750208

(51) Int. Cl.
*F23R 3/00* (2006.01)
*F23R 3/60* (2006.01)

(52) U.S. Cl.
CPC ..... *F23R 3/60* (2013.01); *F23R 3/002* (2013.01); *F23R 2900/00012* (2013.01)

(58) Field of Classification Search
None
See application file for complete search history.

(56) References Cited

U.S. PATENT DOCUMENTS 5,353,587 A * 10/1994 Halila ..... F23R 3/002 60/756
7,051,532 B2 * 5/2006 Howell ..... F23R 3/10 60/757
7,093,440 B2 * 8/2006 Howell ..... F23R 3/60 60/800
9,964,307 B2 * 5/2018 Sullivan ..... F23R 3/48
(Continued)

FOREIGN PATENT DOCUMENTS

EP 3 078 914 A1 10/2016

*Primary Examiner* — Todd E Manahan
*Assistant Examiner* — Sean V Meiller
(74) *Attorney, Agent, or Firm* — Blank Rome LLP

(57) ABSTRACT

A combustion chamber for a turbine engine, in particular for an aircraft turbojet engine or turboprop engine. The combustion chamber includes a radially outer annular shroud, a radially inner annular shroud coaxial with the radially outer shroud, and an end wall connecting the radially outer shroud and the radially inner shroud. The combustion chamber further includes a first annular sealing member coaxial with said radially inner and outer shrouds. The first annular sealing member is radially interposed between the end wall and the radially outer shroud.

11 Claims, 3 Drawing Sheets

(56) References Cited

U.S. PATENT DOCUMENTS

| | | | | |
|---|---|---|---|---|
| 10,295,189 | B2 * | 5/2019 | Pidcock | F23R 3/10 |
| 10,436,446 | B2 * | 10/2019 | Dery | F23R 3/002 |
| 11,029,028 | B2 * | 6/2021 | Bengtson | F23R 3/50 |
| 2004/0250548 | A1 | 12/2004 | Howell et al. | |
| 2008/0230997 | A1 | 9/2008 | Boston et al. | |
| 2013/0247575 | A1 * | 9/2013 | Patel | F23R 3/04 60/752 |
| 2016/0102864 | A1 * | 4/2016 | Metternich | F23R 3/60 60/756 |
| 2016/0215981 | A1 | 7/2016 | Dery | |
| 2017/0059160 | A1 * | 3/2017 | Bloom | F23R 3/60 |
| 2018/0073738 | A1 * | 3/2018 | Rasmusson | F23R 3/60 |

* cited by examiner

TURBINE ENGINE COMBUSTION CHAMBER

CROSS-REFERENCE TO RELATED APPLICATIONS

This application is a national stage of International Application No. PCT/FR2018/050021, filed on Jan. 4, 2018, which claims the benefit of French Patent Application No. 1750208, filed on Jan. 10, 2017, the contents of each of which are incorporated by reference herein.

The present invention relates to an assembly for a turbine engine, particularly for an aircraft turbojet engine or a turboprop engine.

A turbine engine, specifically a twin-spool turbine engine, conventionally includes, in the downstream direction, a fan, a low pressure compressor, a high pressure compressor, a combustion chamber, a high pressure turbine and a low pressure turbine.

Conventionally, in the present application, "upstream" and "downstream" are defined relative to the direction of the air flow in the turbine engine. Conventionally, in the present application, "inner" and "outer", "lower" and "upper" and "internal" and "external" are similarly defined radially relative to the axis of the turbine engine.

A combustion chamber typically consists of a radially outer annular shroud, a radially inner annular shroud, coaxial with the radially outer shroud, and an end wall connecting the radially outer shroud and the radially inner shroud.

The end wall has radially outer and inner cylindrical parts. In addition, the outer and inner shrouds each have a cylindrical part at their upstream end.

The outer cylindrical part of the end wall is bolted to the cylindrical part of the outer shroud. The inner cylindrical part of the end wall is bolted to the cylindrical part of the inner shroud.

In order to enable the end wall to be mounted between the outer and inner shrouds and due to the dimensional tolerances of manufacture, a radial annular clearance exists between the above-mentioned cylindrical parts. After tightening the bolts and due to the above-mentioned clearance, the interface between the cylindrical parts of the shrouds and the cylindrical parts of the end wall delimits lobes. Such lobes between the above-mentioned cylindrical parts allow parasitic air to enter the combustion chamber or combustion gas to escape therefrom. This affects the efficiency of the combustion chamber and can generate a pollution phenomenon.

For example, these openings can represent an air passage surface of about 300 $mm^2$, or 3% of the total air flow into the combustion chamber.

The invention more particularly aims at providing a simple, efficient and cost-effective solution to this problem.

To this end, it provides for a combustion chamber for a turbine engine, in particular for an aircraft turbojet or a turboprop engine, comprising:

- a radially outer annular shroud,
- a radially inner annular shroud, coaxial with the radially outer shroud,
- a end wall connecting the radially outer shroud and the radially inner shroud, characterized in that it comprises a first annular sealing member, coaxial with said radially inner and outer shrouds, the first sealing member being radially interposed between the end wall and the radially outer shroud.

The combustion chamber may comprise a second annular sealing member, coaxial with said radially inner and outer shrouds, the second sealing member being radially interposed between the end wall and the radially inner shroud.

The sealing element makes it possible to fill the radial clearance between the end wall and the corresponding shroud of the combustion chamber, in order to limit the passage of air at the above-mentioned interface areas. This improves the performance of the turbine engine and limits the sources of pollution.

Each sealing member can be sectorized and include at least two angular sectors.

In this way, each angular sector can be slightly deformed in order to adapt to the actual diameter of the interface area considered. Each angular sector can then optimally close said interface area.

For each sealing member, the angular sectors can be distributed over the circumference with a total angular clearance between them between 0 and 1° or 0 and 5 mm.

The total clearance between the sectors is for example between 0 and 1° or 0 and 5 mm, for an implantation diameter between 500 and 650 mm, for example.

This spacing makes it possible in particular for the sectors to be deformed when they are conformed to the above-mentioned interface zones.

The outer shroud of the combustion chamber may comprise a cylindrical part surrounding a radially outer cylindrical part of the end wall, the end wall may further comprise at least a radially inner cylindrical part surrounding a cylindrical part of the inner shroud of the combustion chamber, the first sealing member being insertable between the cylindrical part of the outer shroud and the outer cylindrical part of the end wall, the second sealing member being insertable between the cylindrical part of the inner shroud and the inner cylindrical part of the end wall.

The combustion chamber may include a thermal protection element located downstream of the end wall.

This thermal protection device protects the end wall and the elements located upstream thereof from high temperatures within the combustion chamber.

The protective member may be a metal sheet with a radially extending annular part, the inner and outer peripheral edges of which are extended by annular flanges extending axially in the downstream or upstream direction.

The radially outer flange of the thermal protection device may be located near the outer shroud of the chamber, i.e. at a distance between 0.1 and 2.5 mm.

The radially inner flange of the thermal protection device may be located near the inner shroud of the chamber, i.e. at a distance between 0.1 and 2.5 mm.

The radially outer and inner flanges of the protective member can extend axially upstream and can be radially inserted respectively between the outer shroud and the end wall, and between the inner shroud and the end wall.

Each sealing element can be made of nickel-based alloy, for example Hastelloy® type, or cobalt-based alloy.

Such a material is able to withstand thermal stresses in operation.

Each sealing member can have a thickness between 0.8 and 3 mm.

The sealing member can be provided with fixing holes, evenly distributed over the circumference.

Each sealing member can be fixed to the end wall by means of fixing means, such as screws.

Said screws or rivets can be inserted into the fixing holes of the corresponding sealing member.

In this case, the screws or rivets can first be engaged into the holes located in the circumferentially median zone of the corresponding angular sector, then gradually into the holes located near the circumferential ends of the sector.

Each sector of the sealing member may be in the form of an arc-shaped strip.

The thermal protection element can be in the form of a metal sheet with a thickness between 0.5 and 1.5 mm.

The thermal protection element can be made of nickel-based alloy, for example Hastelloy® type, or cobalt-based alloy.

At least one of the inner and outer shrouds of the combustion chamber may have cut-outs opening in the upstream direction.

The combustion chamber may comprise an upstream cover comprising a radially outer annular fixing part, fixed to the outer shroud of the combustion chamber, said cover also comprising a radially inner annular fixing part, fixed to the outer shroud of the combustion chamber.

The radially inner surface of the outer shroud may have an annular recess, the downstream axial end of which forms an annular radial shoulder, the first sealing member being housed, at least in part, in the recess, the downstream end of each angular sector of the first sealing member being able to rest on the shoulder.

Such a characteristic improves the sealing feature in this area.

The invention also relates to a turbine engine, such as an aircraft turbojet or a turboprop, comprising a combustion chamber of the type described in the preceding paragraph.

The invention will be better understood and other details, characteristics and advantages of the invention will become readily apparent upon reading the following description, given by way of a non limiting example with reference to the appended drawings, wherein:

FIG. 1 shows a cross-sectional view of a turbine engine according to the invention, FIG. 2 is a detailed cross-sectional view showing a combustion chamber of the turbine engine of FIG. 1, FIG. 3 is a detailed view, according to a first embodiment, of the junction between the radially outer shroud and the end wall of the combustion chamber, FIG. 4 is a perspective view of a sealing member that can be radially mounted between the radially outer shroud and the end wall of the combustion chamber, FIG. 5 is a detailed view of the sealing member of FIG. 4;

Figure 1:
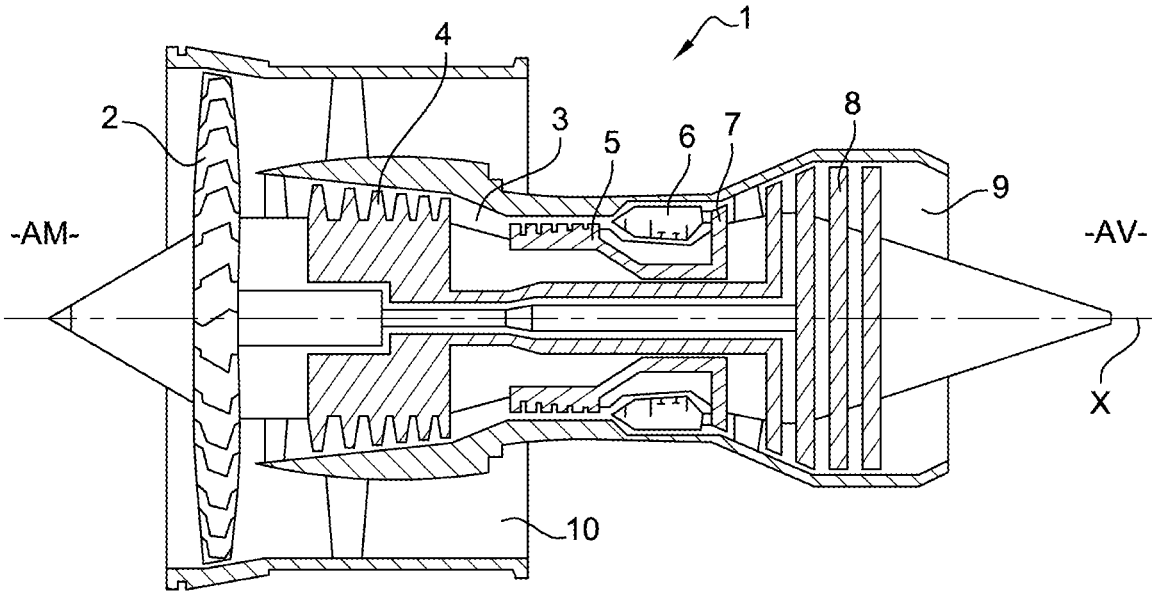
FIG. 1 shows a schematic cross-sectional view of a turbine engine 1 according to the invention. The turbine engine 1 is of the twin spool turbo-fan type, and extends along a longitudinal axis X.

The turbine engine 1 includes a fan 2 that sucks in an air flow that is divided into a primary and a secondary flow. The primary flow passes through a primary section 3 which includes, successively, in the downstream direction AV, a low pressure compressor 4 and a high pressure compressor 5. At the outlet of the high-pressure compressor 5, air is injected and mixed with fuel into a combustion chamber 6. At the outlet of the combustion chamber 6, hot gases successively pass through a high-pressure turbine 7 and a low-pressure turbine 8 before being ejected from the turbine engine 1 through an ejector nozzle 9.

The secondary flow crosses a secondary section 10 surrounding the primary section 3.

Figure 2:
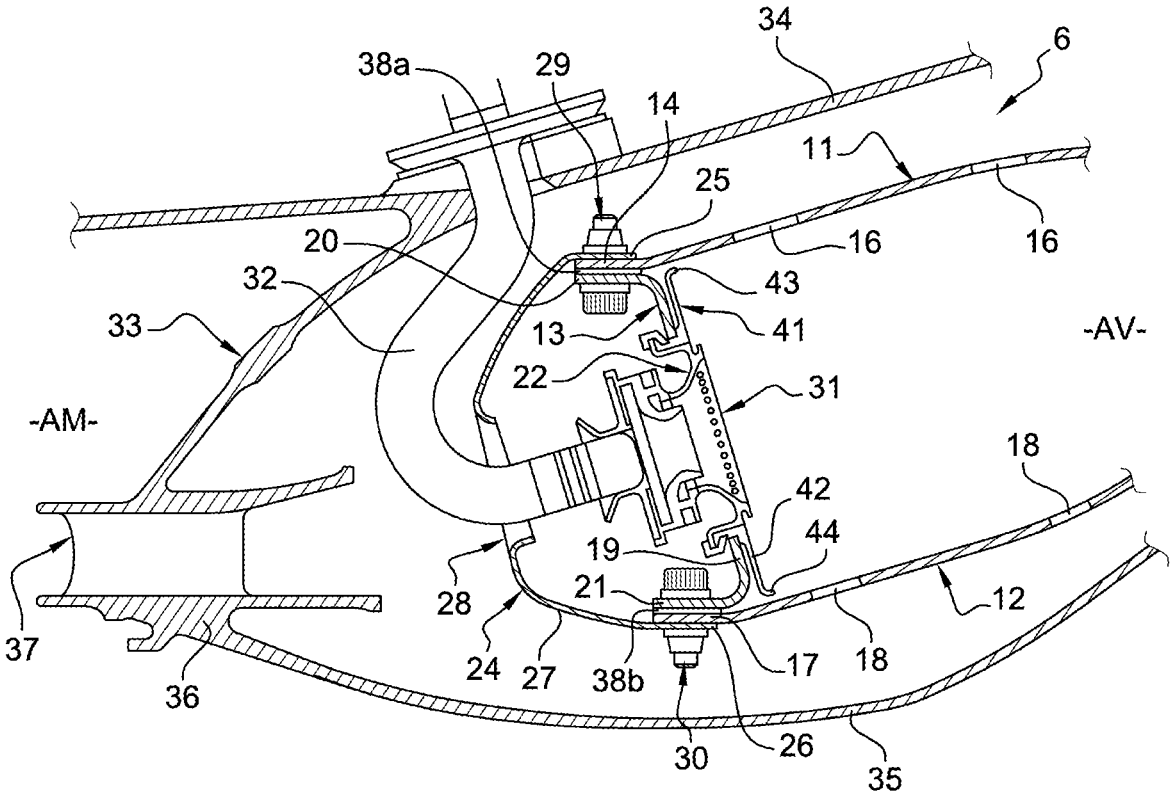
Figure 7:
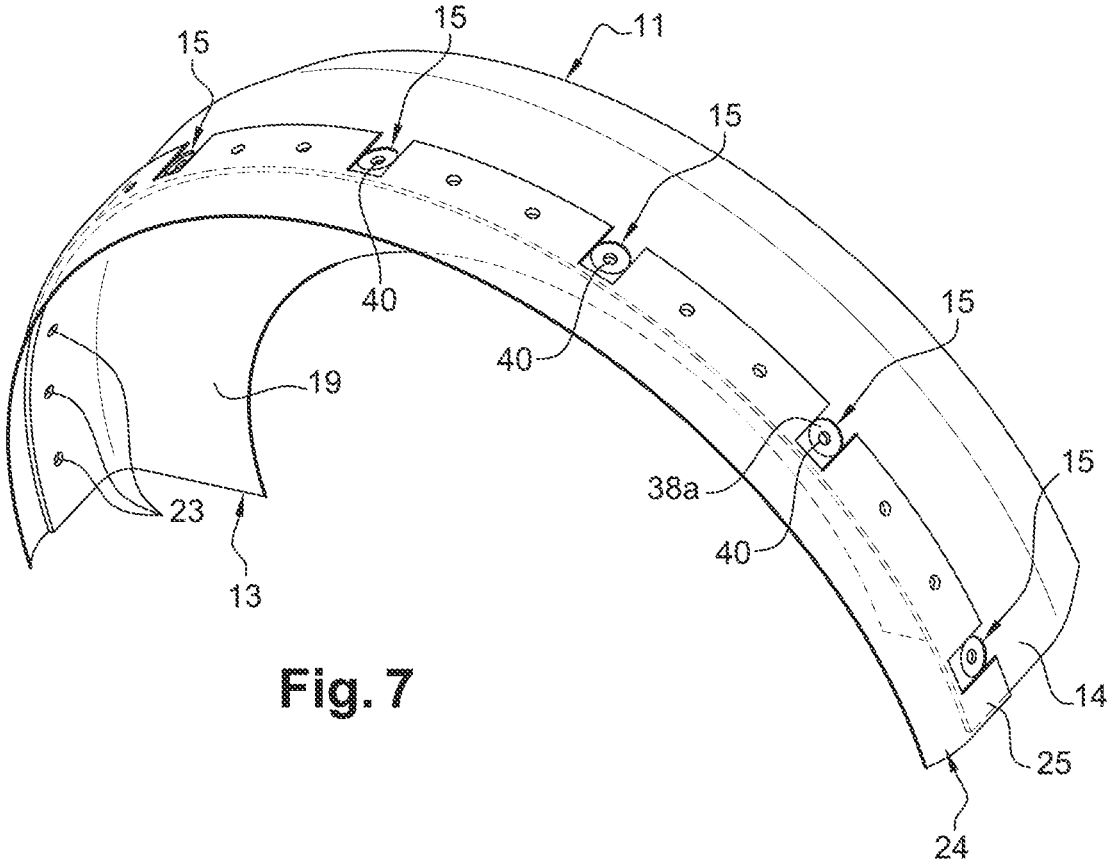
FIG. 7 is a schematic top view, in perspective, showing an upstream cover added in a combustion chamber according to the invention.

FIGS. 2 and 7 show several embodiments of the combustion chamber 6 of the turbine engine 1 according to the invention.

With reference to FIG. 2, the combustion chamber 6 comprises a radially outer annular shroud 11, a radially inner annular shroud 12, and a radially extending annular end wall 13 connecting the radially outer shroud 11 and the radially inner shroud 12.

The outer shroud 11 has a general frustoconical shape that widens in the downstream direction AV. The outer shroud 11 includes, at its upstream end, a cylindrical part 14. Said cylindrical part 14 has holes distributed around the circumference. The cylindrical part 14 also includes 15 cuts distributed over the circumference, said 15 cuts opening in the upstream direction AM.

The outer shroud 11 also has air inlet holes 16, also known as primary holes.

The inner shroud 12 has a general frustoconical shape that widens in the downstream direction AV. The inner shroud 12 includes, at its upstream end, a cylindrical part 17. Said cylindrical part 17 has holes distributed around the circumference. The cylindrical part 17 also includes cut-outs distributed over the circumference, said cut-outs opening in the upstream direction AM.

The inner shroud 12 also has air inlet holes 18.

The end wall 13 is annular and has a part 19 that is generally frustoconical or radially extending. The radially outer periphery of the frustoconical or radial part is extended by a cylindrical part 20 extending in the upstream direction AM. The radially inner periphery of the frustoconical or radial part is extended by a cylindrical part 21 extending in the upstream direction AM. The end wall 13 has openings 22 distributed over the circumference of the frustoconical part 19. In addition, the cylindrical parts 20, 21 of the end wall 13 have fixing holes 23 distributed around the circumference.

The combustion chamber 6 also includes an annular cover 24 with a generally C-shaped cross-section, located upstream AM of the end wall 13. The radially outer periphery of the cover 24 includes a cylindrical part 25. Similarly, the radially inner periphery of the cover 24 includes a cylindrical part 26. The radially median area 27 of the cover 24 has openings 28 axially opposite the openings 22 in the end wall 13.

The outer cylindrical part 25 of the cover 24, the cylindrical part 14 of the outer shroud 11 and the outer cylindrical part 20 of the end wall 13 are fixed to each other by means of bolts 29 distributed over the circumference and engaged in the holes of the cylindrical part 14 of the outer shroud and the fixing holes 23 of the end wall 13. In particular, the outer cylindrical part 25 of the cover 24 surrounds the cylindrical part 14 of the outer shroud 11, which in turn surrounds the outer cylindrical part 20 of the end wall 13.

The inner cylindrical part 26 of the cover 24, the cylindrical part 17 of the inner shroud 12 and the inner cylindrical part 21 of the end wall 13 are fixed to each other by means of bolts 30 distributed over the circumference and engaged in the holes of the cylindrical part 17 of the inner shroud 12 and the fixing holes 23 of the end wall 13. In particular, the inner cylindrical part 21 of the end wall 13 surrounds the cylindrical part 17 of the inner shroud 12, which in turn surrounds the inner cylindrical part 26 of the cover 24.

Each opening 22 in the end wall 13 is used to mount a fuel injection device 31. The fuel injection device 31 is connected to an injection pipe 32 forming a fuel supply line, said injection pipe 32 passing through the corresponding opening 28 of the cover 24. The structure of the injection device 31 is known per se and will not be described in greater details.

The downstream end (not shown) of the combustion chamber 6 is fixed on an external housing 33. Said outer casing 33 comprises a radially outer wall 34 and a radially inner wall 35 connected at their upstream end. The junction 36 between the radially inner wall and the outer wall includes an air inlet port 37, allowing air from the high-pressure compressor 5 to enter the inner volume of the outer casing 33. The air thus passes through said orifice 37 and then divides into a first part which passes through the opening 28 of the cover 24 and enters the fuel injection device 31 wherein it is mixed with the fuel. A second part of the air bypasses the cover 24 and then enters the combustion chamber 6 through the holes 16, 18 of the inner 12 and outer 11 shrouds.

In the embodiments shown in the figures, the housing is formed in one piece, i. e. the radially outer walls 34 and radially inner walls 35 form a single piece with the junction 36. For example, the walls 34, 35 and the junction 36 are produced in one piece. As an alternative solution, the walls 34, 35 could be attached and fixed to the junction 36, the walls 34, 35 and the junction 36 being independent of each other.

As previously indicated, a radial annular clearance exists between the above-mentioned cylindrical parts 14, 17, 20, 21 of the shrouds 11, 12 and the end wall 13, in order to enable the assembly of the end wall 13 between the shrouds 11, 12 and due to the dimensional tolerances of manufacture.

According to the invention, the combustion chamber 6 includes first and second annular sealing members 38*a*, 38*b* to fill such clearance.

The first sealing element 38*a* is inserted radially between the end wall 13 and the radially outer shroud 11. The second sealing element 38*b* is inserted radially between the end wall 13 and the radially inner shroud 12.

Except in their dimensions, the first sealing member 38*a* and the second sealing member 38*b* are concentric and have identical structures.

Figure 4:
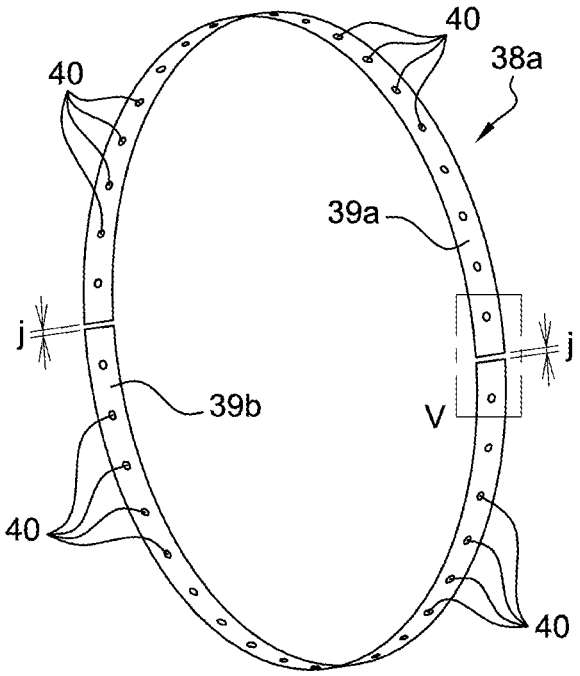

Each annular sealing member 38*a*, 38*b* is annular and formed by at least two angular sectors 39*a*, 39*b* (only the first sealing member 38*a* is shown in FIG. 4), here two angular sectors 39*a*, 39*b*. Each sector 39*a*, 39*b* is curved and has a circular arc shape. Each sector 38*a*, 38*b* has, on its circumference, fixing holes 40 evenly distributed over the circumference.

Figure 5:
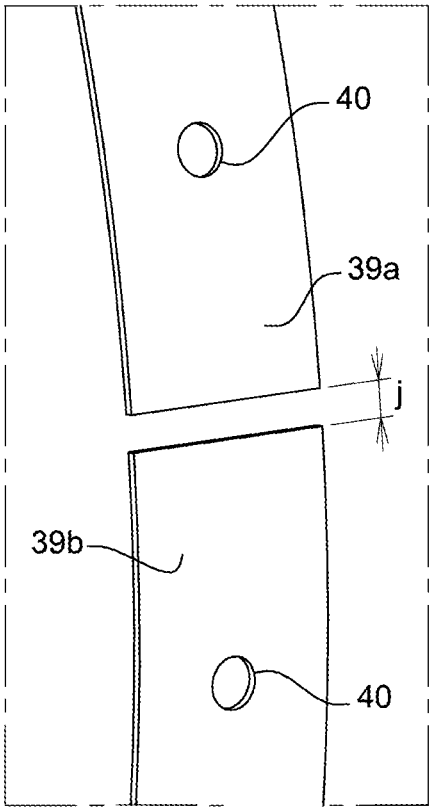

The angular sectors 39*a*, 39*b* are distributed over the circumference of the cylindrical part 20 of the end wall 13 and are slightly spaced by a clearance noted j from each other at their ends, as best visible in FIG. 5. The total angular clearance between the sectors is for example between 0 and 1° or 0 and 5 mm.

Each sector 39*a*, 39*b* of each sealing member 38*a*, 38*b* is made of nickel-based alloy, for example Hastelloy® type, or Cobalt-based alloy. Each sector 38*a*, 38*b* has a thickness between 0.8 and 3 mm.

The sectors 39*a*, 39*b*, of each sealing member 38*a*, 38*b* are secured by bolts (not shown) engaged only in some of the fixing holes 23 of the corresponding cylindrical part 20, 21 of the end wall 13 and in the holes of the sectors 39*a*, 39*b* of the sealing member 38*a*, 38*b*. The screw heads or the nuts of these bolts are located at cut-outs 15 of the corresponding shroud 11, 12.

Figure 3:
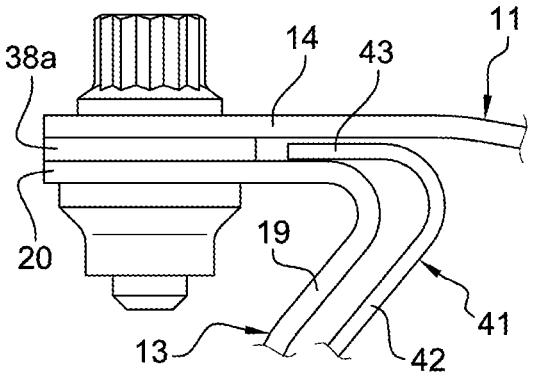

The combustion chamber 6 also has a thermal protection element 41 located downstream of the end wall 13, in the form of an annular metal sheet. The protective member 41 has an annular part 42, frustoconical shaped or extending in a radial plane, the inner and outer peripheral edges of which are extended by annular flanges 43, 44 extending axially in the upstream direction AM (FIG. 3).

The outer flange 43 of the protective member 41 is radially interposed between the cylindrical part 14 of the outer shroud 11 and the outer cylindrical part 20 of the end wall 13. In addition, the outer flange 43 of the protective member 41 is located downstream AV of the first sealing member 38*a*.

The inner flange of the protective member 41 (not shown in FIG. 3) is radially interposed between the cylindrical part 17 of the inner shroud 12 and the inner cylindrical part 21 of the end wall 13. In addition, the inner flange of the protective member 41 is located downstream AV of the second sealing member 38*b*.

Figure 6:
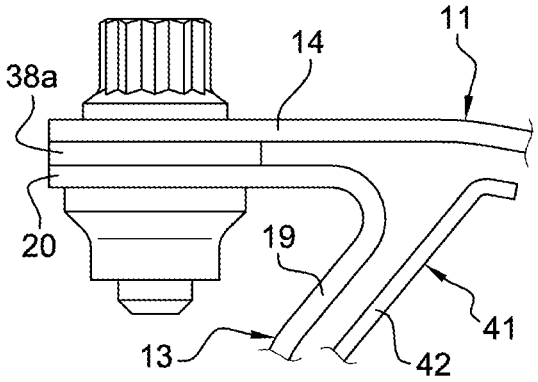
FIG. 6 is a detailed view, in a second alternative embodiment, of the junction between the radially outer shroud and the end wall of the combustion chamber.

As an alternative solution, the flanges 43, 44 of the protective member can extend axially in the downstream direction AV, as shown in FIGS. 2 and 6.

As previously indicated, each sealing member 38*a*, 38*b* fills the radial clearance between the end wall 13 and the corresponding shroud 11, 12 of the combustion chamber 6, in order to limit the passage of air to the above-mentioned interface areas. This improves the performance of the turbine engine 1 and limits the sources of pollution.

In addition, each angular sector 39*a*, 39*b* can be slightly deformed in order to adapt to the actual diameter of the cylindrical part 14, 17 of the corresponding shroud 11, 12 and the corresponding cylindrical part 20, 21 of the end wall 13. Each angular sector 39*a*, 39*b* can then optimally close the interface area between the end wall 13 and the corresponding shroud 11, 12.

Figure 8:
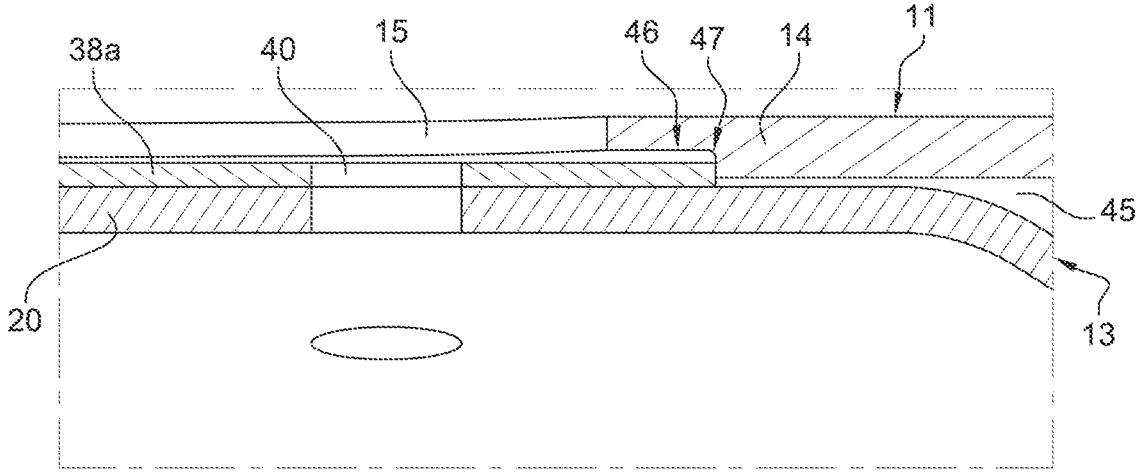
FIG. 8 is a cross-sectional view illustrating the positioning of the sealing member radially between the end wall and the radially outer shroud, according to a second embodiment of the invention.

FIG. 8 represents a second embodiment, which differs from the one described in reference to FIGS. 1 to 7, in that the radially inner surface 45 of the outer shroud 11 has an annular recess 46, the downstream axial end of which forms an annular radial shoulder 47.

In this embodiment, the first sealing member 38*a* is housed, at least in part, in the recess 46, the downstream end of each angular sector 39*a*, 39*b* of the first sealing member 38*a* being able to rest on the shoulder 47.

It should be noted that the downstream end of each sector 39*a*, 39*b* of the first sealing member 38*a* and the shoulder 47 mentioned above form a baffle making it possible to limit the passage of air between these elements.

The invention claimed is:

1. A combustion chamber for a turbine engine, the combustion chamber comprising:

a radially outer annular shroud, a radially inner annular shroud, coaxial with the radially outer shroud, an end wall connecting the radially outer shroud and the radially inner shroud, wherein the combustion chamber comprises a first annular sealing member, coaxial with said radially inner and outer shrouds, the first annular sealing member being radially interposed between the end wall and the radially outer shroud, and each sealing member is sectorized and comprises at least two angular sectors, wherein the first annular sealing member is secured in radial contact with the end wall by bolts engaged only in fixing holes of the first annular sealing member and corresponding fixing holes of the end wall, wherein the combustion chamber further comprises a second annular sealing member, coaxial with said radially inner and outer shrouds, the second sealing member being radially interposed between the end wall and the radially inner shroud, and wherein the outer shroud of the combustion chamber comprises a cylindrical part surrounding a radially outer cylindrical part of the end wall, the end wall further comprising at least one radially inner cylindrical part surrounding a cylindrical part of the inner shroud of the combustion chamber, the first sealing member being interposed between the cylindrical part of the outer shroud and the outer cylindrical part of the end wall, the second sealing member being interposed between the cylindrical part of the inner shroud and the inner cylindrical part of the end wall.

2. The combustion chamber according to claim 1, wherein, for each sealing member, the angular sectors are distributed over the circumference with a total angular clearance between them between 0° and 1° or between 0 mm and 5 mm.

3. The combustion chamber according to claim 1, further comprising a thermal protection element located downstream (AV) of the end wall.

4. The combustion chamber according to claim 3, wherein the thermal protection element is a sheet metal having a radially extending annular part with radially inner and outer peripheral edges extended by annular edges extending axially in the downstream (AV) or in the upstream (AM) direction.

5. The combustion chamber according to claim 4, wherein the radially outer and inner peripheral edges of the thermal protection element extend axially upstream (AM) and are radially interposed respectively, between the outer shroud and the end wall, and between the inner shroud and the end wall.

6. The combustion chamber according to claim 1, wherein each sealing member is made of a nickel-based alloy or a cobalt-based alloy.

7. The combustion chamber according to claim 1, wherein each sealing member has a thickness between 0.8 and 3 mm.

8. The combustion chamber according to claim 1, wherein the radially inner surface of the outer shroud has an annular recess, the downstream axial end of which forms an annular radial shoulder, the first sealing member being accommodated, at least in part, in the recess, the downstream end of each angular sector of the first sealing member being able to rest on the shoulder.

9. A turbine engine comprising a combustion chamber according to claim 1.

10. The combustion chamber according to claim 1, wherein a second annular sealing member is secured in radial contact with the end wall by bolts engaged only in fixing holes of the second annular sealing member and corresponding fixing holes of the end wall.

11. The combustion chamber according to claim 1, wherein screw heads or nut of the bolts are located at cut-outs of the radially outer shroud.

* * * * *